United States Patent [19]

Rickard

[11] B 3,992,972

[45] Nov. 23, 1976

[54] PICKUP MOUNTING FOR STRINGED INSTRUMENT

[75] Inventor: James H. Rickard, Harwinton, Conn.

[73] Assignee: Ovation Instruments, Inc., New Hartford, Conn.

[22] Filed: Mar. 10, 1975

[21] Appl. No.: 556,897

[44] Published under the second Trial Voluntary Protest Program on February 3, 1976 as document No. B 556,897.

[52] U.S. Cl. ..... 84/1.16; 84/1.15

[51] Int. Cl.[2] ..... G10H 3/00; G10H 3/08

[58] Field of Search ..... 84/1.04, 1.06, 1.14–1.16, 84/DIG. 24

[56] References Cited

UNITED STATES PATENTS

| | | | |
|---|---|---|---|
| 2,089,171 | 8/1937 | Beauchamp | 84/1.15 |
| 2,573,254 | 10/1951 | Fender | 84/1.16 |
| 2,612,541 | 9/1952 | De Armond | 84/1.15 X |
| 2,921,494 | 1/1960 | Leslie | 84/1.04 |
| 3,535,968 | 10/1970 | Rickard | 84/1.15 |
| 3,668,295 | 6/1972 | Broussard | 84/1.15 |
| 3,725,561 | 4/1973 | Paul | 84/1.15 |

*Primary Examiner*—L. T. Hix
*Assistant Examiner*—Stanley J. Witkowski
*Attorney, Agent, or Firm*—McCormick, Paulding & Huber

[57] ABSTRACT

A guitar or similar stringed musical instrument includes an electrical pickup located beneath the strings for transforming the string vibrations into electrical signals subsequently amplified to provide an electronically enhanced reproduction of the string sound. The pickup is of the magnetic induction type having no direct mechanical connection with the strings. The system for mounting the pickup from the body of the instrument inhibits the transmission of vibrations from the instrument body to the pickup to minimize extraneous noise in the output signal, and it is also one which is of relative simplicity and low cost and which provides for easy adjustment of the pickup relative to the strings.

7 Claims, 5 Drawing Figures

PICKUP MOUNTING FOR STRINGED INSTRUMENT

BACKGROUND OF THE INVENTION

This invention relates to magnetic induction type pickups for stringed musical instruments, and deals more particularly with an improved mounting system for attaching such a pickup to the body of an instrument.

Magnetic induction type pickups for stringed musical instruments are ones which are conventionally mounted beneath and close to the strings of an instrument and wherein, as a string vibrates, the reluctance of an associated flux path through the pickup is varied to produce a varying magnetic flux which in turn induces a varying electrical output voltage in an associated coil. Thee output signal is then amplified, and perhaps also distorted and modified in various different ways, to produce an output signal driving one or more electro-acoustical speakers. Sometimes, the performer is located so close to the speakers, and the sound level from the speakers is so great, that the sound vibrations in the air set up vibrations in the instrument body which are fed back through the body to the electrical pickup to vibrate the pickup and to thereby establish a positive feedback conditions producing microphonics or squeal in the speaker output. Also, as the instrument is played, it is subject to various knocks or blows from the performers' hands or other objects, and vibrations from these impacts are also often transmitted to the pickup to produce an undesirable audible response from the speakers.

The general object of this invention is, therefore, to provide a mounting system for an electrical pickup in a stringed musical instrument whereby transmission of vibrations from the instrument body to the pickup is minimized to reduce undesirable microphonics and other noise in the associated speaker output.

A further object of the invention is to provide a pickup mounting system for a stringed musical instrument which is of a relatively low cost, of a simplified and easily assembled construction and which allows for adjustably raising and lowering the pickup or tilting it about various different axes to vary its position relative to the strings.

Other objects and advantages of the invention will be apparent from the drawings and from the following description thereof.

SUMMARY OF THE INVENTION

The invention resides in an electrical pickup mounting system for a stringed musical instrument of the type wherein at least a part, and usually the major portion, of the pickup is located in a cavity below a top plate of the instrument, with the pickup having a part extending through an opening in the top plate toward the strings. Below the top plate the pickup has a laterally outwardly extending mounting flange, preferably in the form of two ears at its opposite ends. The flange carries a number of mounting elements of rubber or similar resilient material, and each mounting element has an opening facing the top plate. A plurality of screws, one for each mounting element, extend through the top plate and each has a threaded shank extending into the opening of its associated mounting element and threadably connected thereto by a coengaging part received in the mounting element opening and separate from the mounting element. A helical compression spring is received on each screw shank and is compressed between the top plate and the associated retaining element. Together the resilient mounting elements and the helical compression springs introduce such spring and damping factors between the instrument body and the pickup as to minimize the transmission of vibration between the two parts over a wide range of frequencies. Preferably, the resilient mounting members are externally waisted grommets assembled with the mounting flange by being laterally slid into blind slots of the pickup flange; and, the parts which threadably engage the shanks of the screws are self-threading bosses of Delrin or similar thread stripping resistant plastic extending into the grommet eyes from a retaining member located below the grommets and to which all of the bosses are fixed to both hold the bosses from turning as the screws are threaded into or out of them and to hold the bosses laterally in place in their mounting flange slots.

DETAILED DESCRIPTION OF THE PREFERRED EMBODIMENT

Figure 1:
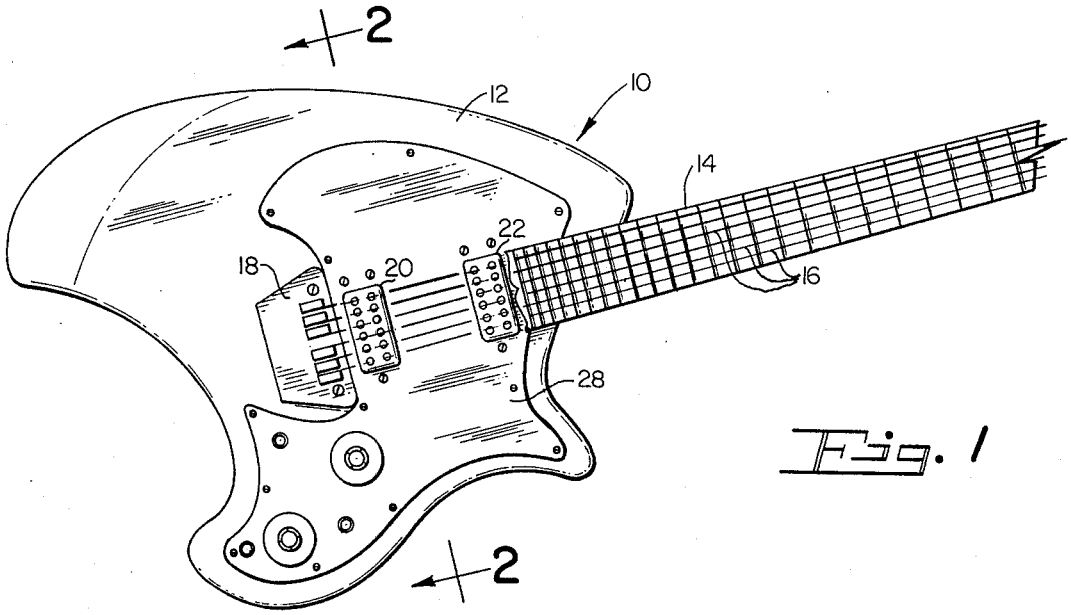
FIG. 1 is a plan view of a port of a guitar having an electrical pickup with a mounting system embodying this invention.

Referring to FIG. 1, this figure shows a guitar 10 having a body 12, a neck 14 and a set of strings 16 extending along the length of the neck and attached at their lower ends to a bridge and tail piece unit 18 fixed to the body 12. Included in the instrument are two electrical pickups 20 and 22 located beneath the strings 16 and at spaced points along the length thereof. Because of the different locations of the two pickups 20 and 22 and the fact that the character of the vibration of each string is different at different points along its length, slightly different output signals will be produced from each of the two pickups 20 and 22, and by suitable switches the performer may select either one or both of the pickups as the electrical signal source. The illustrated arrangement of the two pickups 20 and 22 is in general well known and is shown by way of example only. That is, the mounting system of this invention pertains to the mounting of an individual pickup from the associated instrument body. Where the instrument includes two pickups, as in the case of FIG. 1, both pickups may and preferably do utilize the mounting system of this invention. In cases where the instrument has only a single pickup, the mounting system of this invention may be used with such pickup with equal effect.

Further, the guitar 10 of FIG. 1 is of the "solid body" type wherein the body 12 is made of a single piece of solid wood or other material having relatively small cavities for receiving the pickups and other components. This again, however, is a matter of choice for purposes of explanation, and the invention is not necessarily limited to such type of guitar and may as well be used in mounting pickups to various other kinds of stringed instruments including hollow bodied instruments having bodies made of relatively thin-walled material enclosing relatively large cavities.

Regardless of the type of instrument involved, the pickup mounting system of this invention is one wherein a major part of the pickup is mounted within a body cavity defined in part by a top plate having an opening through which the pickup projects outwardly toward the strings. In the illustrated case, as shown by FIG. 2, the cavity, indicated at 24, is of a relatively small size, is cut out of the material of the body 12 and is covered by a top plate 26 constituting a portion of a pick guard 28 fastened to the top surface of the body 12.

Figure 2:
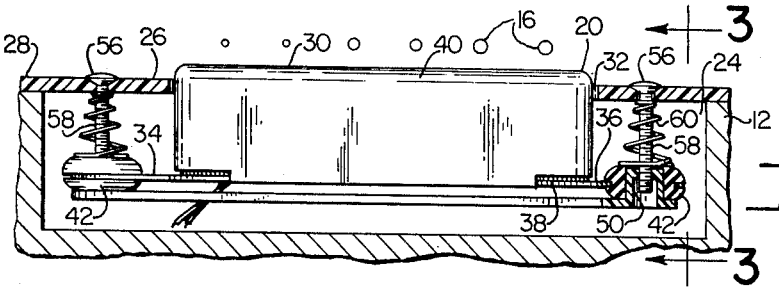
FIG. 2 is an enlarged fragmentary sectional view taken on the line 2—2 of FIG. 1.
Figure 5:
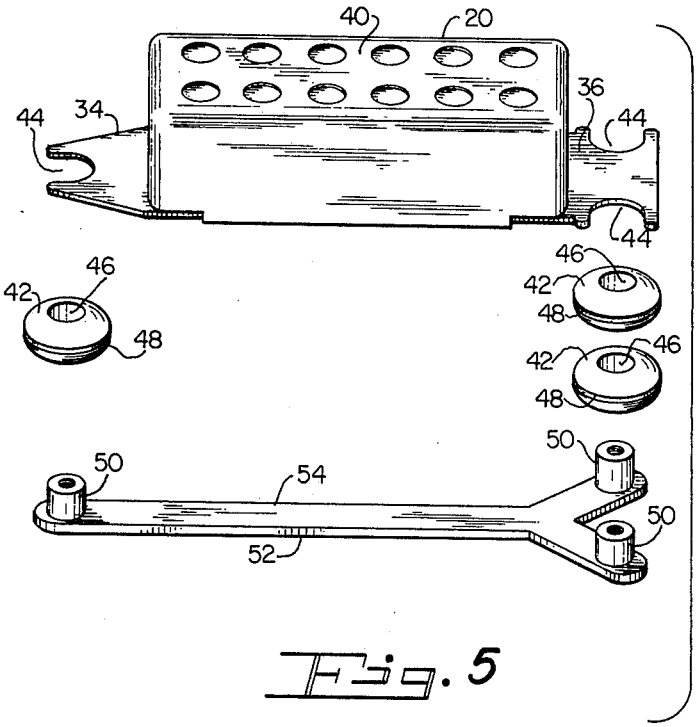
FIG. 5 is an exploded perspective view of a portion of the mounting system shown in FIG. 2.

FIG. 2 illustrates the pick 20 and its associated mounting system. A similar mounting system, not shown herein in detail, may be used with the pickup 22. Each of the pickups 20 and 22 is of the magnetic induction type and may be any one of various different forms and constructions well known in the art. Preferably, however, it is of the type shown and described in copending patent application, filed Mar. 10, 1975, Ser. No. 556,896, entitled MAGNETIC INDUCTION STRINGED INSTRUMENT PICKUP, to which application reference may be had for further details of its construction.

Referring to FIGS. 2 to 5, the pickup 20 includes a main body 30 which extends through a conforming opening 32 in the top plate 26. Inwardly or rearwardly of the top plate 26 the pickup includes a laterally outwardly extending mounting flange in the form of two ears 34 and 36 located at opposite ends of the pickup. These ears are outwardly extending continuations of a base plate 38 to which a rectangular cup-shaped case or housing 40 of the main body is attached. Both the case 40 and the base plate 38 are made of an electrically conductive non-magnetic material, such as brass. Carried by the ears 34 and 36 are three resilient mounting elements in the form of rubber grommets 42, 42. The grommets are received in blind slots 44, 44 extending inwardly from the outer edges of the ears 34 and 36. Each grommet 42 is of the type having a central eye 46 and an external waist or reduced diameter portion 48. The waist portion 48 has an external diameter substantially equal to the width of each blind slot 44, 44, and an axial length substantially equal to the thickness of the ears, so that each grommet may be assembled with its ear 34 or 36 by being slid laterally into its associated blind slot 44, and once a grommet is in such assembled position it is restrained against movement relative to its ear in all directions except for outward sliding movement.

After the three grommets 42, 42 are assembled with the two ears 34 and 36, they are locked in such assembled positions by inserting into their eyes 46, 46, and from their rears, the three bosses 50, 50 of a retaining member 52, the retaining member 52 having a Y-shaped body 54 to which all three bosses 50, 50 are fixed. From inspection of FIG. 5, it will be understood that the three blind slots 44, 44 face in such relatively different directions that after the bosses are inserted in the grommet eyes, movement of any one of the grommets along the length of its slot is prohibited. In particular, the slot 44 of the ear 34 faces outwardly along an axis generally transverse to the strings 16, 16 and the two slots 44, 44 of the ear 36 face in the opposite directions along an axis generally parallel to the strings.

Passing through the top plate 26 are three screws 56, 56 having slotted heads which engage the outer surface of the top plate. Extending inwardly from its head each screw includes a threaded shank 58 which extends into the eye of its associated grommet and threadably engages the boss 50 also received in the grommet eye.

Finally, to complete the mounting system, each screw 56 has a helical compression spring 60 received on its shank 58 and compressed between the top plate 26 and the associated grommet 42. Accordingly, the three springs 60, 60 provide a degree of resiliency in the support of the pickup 20 from the top plate 26 and urge the pickup to its illustrated normal position. Also, the three grommets 42, 42 add further resilience and damping in the connection between the top plate and the pickup, and this together with the resilient influence of the springs 60, 60 provides a connection which is highly effective in inhibiting the transmission of unwanted vibrations from the top plate to the pickup.

The described mounting system is also relatively inexpensive to produce and easy to assemble. For example, the blind slots 44, 44 are easily cut into the ears 34 and 36, the grommets 42, 42 are readily available at little expense, and the retaining member 54 may be made as a relatively low cost plastic injection molded part. The plastic used for the part 54 is preferably Delrin or some other plastic which allows the screws 56, 56 to self thread into the bosses 50 and which is resistant to thread stripping. Therefore, in making the support system, no machine threading operations are required.

Figure 3:
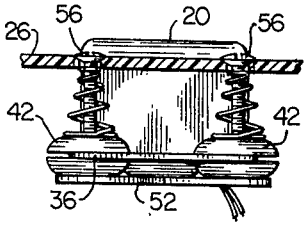
FIG. 3 is an end view taken on the line 3—3 of FIG. 2.
Figure 4:
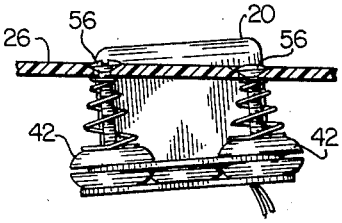
FIG. 4 is an end view similar to FIG. 3 but shows the pickup of FIG. 3 in a different condition of adjustment.

Still further, the illustrated mounting system is one which allows the pickup 20 to be readily moved to different adjusted positions relative to the strings 16, 16 as may be desired to produce a different effect in the output signal. For example, by turning all of three screws 56, 56 the same amount in the same direction, the pickup may be bodily raised or lowered relative to the strings. By turning the two screws 52, 52 of the ear 36 the same amounts in the same direction, while not turning the screw 56 of the ear 34, the end of the pickup adjacent the ear 36 may be raised or lowered relative to the other end. Likewise, by turning the one screw 56 of the ear 34, while not touching the two screws of the ear 36, the end of the pickup adjacent the ear 34 may be raised or lowered relative to the other end. Lastly, as shown in FIGS. 3 and 4, by turning the two screws of the ear 36 in opposite directions while not touching the screw 56 of the ear 34, the pickup 20 may be tilted about an axis extending transversely of the strings. In this connection, it should be observed that the one blind slot 44 of the ear 34 and its associated screw 56 is located midway between the two slots 44, 44, and their associated screws 56, 56 of the ear 36, as measured longitudinally of the strings, so that when the two screws of the ear 36 are adjusted as shown in FIGS. 3 and 4, the pickup 20 pivots about a transverse axis generally defined by the screw 56 of the other ear 34.

I claim:

1. An electrical pickup mounting system for a stringed musical instrument, said mounting system comprising, in combination, a stringed instrument having a set of strings, a body with a top plate, a cavity below said top plate and a hole through said top plate located below said set of strings and communicating with said cavity, a pickup having a housing partially received in said cavity and extending through said opening towards said set of strings, said pickup also including at least one flange extending laterally outwardly from said housing and located in said cavity, a plurality of mounting elements of resilient material carried by said at least one flange and each having an opening facing said top plate, a plurality of screws each having a head on the outer side of said top plate and each having a threaded shank passing through said top plate and extending into the opening of a respective one of said mounting elements, means received in each of said mounting element openings for making threaded connection with the associated one of said screws, and a plurality of helical compression springs each received on a respective one of said screw shanks and compressed between said top plate and the associated one of said mounting elements.

2. An electrical pickup mounting system as defined in claim 1 further characterized by said plurality of mounting elements being comprised of exactly three mounting elements, two of said mounting elements being located on one side of said set of strings and spaced from one another longitudinally of said strings and the other one of said mounting elements being located on the opposite side of said set of strings and at a point longitudinally of said strings generally midway between the other two of said mounting elements.

3. An electrical pickup mounting system as defined in claim 1 further characterized by each of said mounting elements extending through said at least one flange and the opening of each of said mounting elements passing completely through the mounting element, and said means received in each of said mounting element openings for making threaded connection with the associated one of said screws comprising a plurality of screw engaging elements separate from said mounting elements and each received in a respective one of said openings, and a retaining member located on the opposite side of said mounting elements from said top plate and to which each of said screw engaging elements is fixed.

4. An electrical pickup mounting system for a stringed musical instrument, said mounting system comprising, in combination, a stringed instrument having a set of strings, a body with a top plate, a cavity below said top plate and a hole through said top plate located below said set of strings and communicating with said cavity, a pickup partially received in said cavity and extending through said opening towards said set of strings, and pickup including two laterally outwardly extending ears at opposite sides thereof located in said cavity, said ears being generally parallel to and being located below and in spaced relation to said top plate, a plurality of grommets of resilient material carried by said ears, each of said grommets having a central eye passing therethrough along an axis generally perpendicular to said top plate, a retaining member located below said pickup and having a plurality of bosses which extend forwardly toward said top plate and each of which is received in a respective one of said grommet eyes, a plurality of screws each having a head on the outer side of said top plate and each having a shank passing through said top plate and threaded into a respective one of said bosses, and a plurality of helical compression springs each received on a respective one of said screw shanks and compressed between said top plate and the associated one of said grommets.

5. An electrical pickup mounting system for a stringed musical instrument, said mounting system comprising, in combination, a stringed instrument having a set of strings, a body with a top plate, a cavity below said top plate and a hole through said top plate located below said set of strings and communicating with said cavity, a pickup partially received in said cavity and extending through said opening towards said set of strings, said pickup including two laterally outwardly extending ears at opposite sides thereof located in said cavity, said ears being generally parallel to and being located below and in spaced relation to said top plate, each of said ears having at least one blind slot extending laterally inwardly from the edge thereof, a plurality of grommets of resilient material each received in a respective one of said blind slots, each of said grommets having a central eye passing therethrough along an axis generally perpendicular to said top plate, a retaining member located below said pickup and having a plurality of bosses which extend forwardly toward said top plate and each of which is received in a respective one of said grommet eyes, a plurality of screws each having a head on the outer side of said top plate and each having a shank passing through said top plate and threaded into a respective one of said bosses, and a plurality of helical compression springs each received on a respective one of said screw shanks and compressed between said top plate and the associated one of said grommets.

6. An electrical pickup mounting system for a stringed musical instrument as defined in claim 5 further characterized by each of said grommets intermediate its ends having a waist portion of reduced cross section conforming in size to the size of the blind slot in which said grommet is received so that each grommet may be assembled with its associated one of said ears by laterally sliding its waist portion into its associated blind slot, said blind slots facing in relatively different directions so that said bosses of said retaining member after assembly with said grommets hold said grommets against lateral movement in said slots.

7. An electrical pickup mounting system for a stringed musical instrument as defined in claim 5 further characterized by said two ears of said pickup being located on opposite sides of said set of strings, one of said ears having one blind slot facing in the direction transversely away from said set of strings, the other of said ears having two blind slots facing in opposite directions longitudinally of said set of strings, each of said grommets intermediate its ends having a waist portion of reduced cross section conforming in size to the size of the blind slot in which said grommet is received so that each grommet may be assembled with its associated one of said ears by laterally sliding its waist portion into its associated blind slot, said grommets being seated against the inboard ends of their associated blind slots and held in such positions by said bosses of said retaining member.

* * * * *